US011641549B2

(12) United States Patent
Zhang et al.

(10) Patent No.: US 11,641,549 B2
(45) Date of Patent: May 2, 2023

(54) SOUNDING DEVICE

(71) Applicant: AAC Microtech (Changzhou) Co., Ltd., Changzhou (CN)

(72) Inventors: Fan Zhang, Shenzhen (CN); Xin Jin, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 9 days.

(21) Appl. No.: 17/537,529

(22) Filed: Nov. 30, 2021

(65) Prior Publication Data

US 2022/0174417 A1 Jun. 2, 2022

(30) Foreign Application Priority Data

Nov. 30, 2020 (CN) ..... 202022845054.1

(51) Int. Cl.

| | |
|---|---|
| ***H04R 9/02*** | (2006.01) |
| ***H04R 9/04*** | (2006.01) |
| ***H04R 9/06*** | (2006.01) |
| ***H04R 7/16*** | (2006.01) |

(52) U.S. Cl.

CPC ..... *H04R 9/025* (2013.01); *H04R 7/16* (2013.01); *H04R 9/045* (2013.01); *H04R 9/06* (2013.01); *H04R 2400/11* (2013.01); *H04R 2499/11* (2013.01)

(58) Field of Classification Search

CPC ..... H04R 9/022; H04R 1/06; H04R 9/045; H04R 31/006; H04R 7/04; H04R 1/021; H04R 9/027; H04R 2499/11; H04R 2400/11; H04R 2209/027

See application file for complete search history.

(56) References Cited

U.S. PATENT DOCUMENTS

| | | | | |
|---|---|---|---|---|
| 9,813,821 | B1 * | 11/2017 | Song | H04R 9/025 |
| 2018/0302722 | A1 * | 10/2018 | Linghu | H04R 9/025 |
| 2018/0302723 | A1 * | 10/2018 | Xiao | H04R 7/10 |

* cited by examiner

*Primary Examiner* — Alexander Krzystan
*Assistant Examiner* — Julie X Dang
(74) *Attorney, Agent, or Firm* — W&G Law Group

(57) ABSTRACT

Disclosed is a sounding device, including a frame, a vibration system, and a magnetic circuit system. The vibration system includes a diaphragm, a framework, a voice coil, and an elastic conductor. The elastic conductor includes an elastic conductor body, a connection arm, and a pad portion. The connection arm includes a first connection portion, a first bending portion, a second connection portion, a second bending portion, and a third connection portion. A covering film is attached to inner and outer surfaces of the connection arm, and the covering film is moved from inside and/or outside surfaces of the first bending portion and the second bending portion. Removal of the covering film reduces the stress on inner and outer surfaces of bent areas, stabilizes bending angles, reduces springback, and makes pad positions precise.

10 Claims, 8 Drawing Sheets

SOUNDING DEVICE

TECHNICAL FIELD

The present invention relates to the acoustic and electrical field, and in particular to a sounding device.

BACKGROUND ART

With the advent of the Internet era, the number of mobile terminal devices is continuously increasing. Among mobile devices, mobile phones are undoubtedly the most common and most portable mobile terminal devices. Sounding devices for playing sound, such as music, are widely used in mobile terminal devices such as mobile phones, vibration systems in the sounding devices are particularly important, and the entire sounding device vibrates and generates sound through the vibration system.

A sounding device in the related art comprises a frame, a vibration system fixed to the frame, and a magnetic circuit system for driving the vibration system to vibrate and generate sound, wherein the magnetic circuit system has a magnetic gap, and the vibration system comprises a diaphragm fixed to the frame, a voice coil inserted into the magnetic gap for driving the diaphragm to vibrate, a framework connected to the diaphragm and supporting and suspending the voice coil below the diaphragm, and an elastic conductor connected to the side of the framework away from the diaphragm, and the voice coil comprises lead wires electrically connected to the elastic conductor; and the magnetic circuit system comprises a yoke and a magnet fixed to the yoke, and the magnet comprises a main magnet and auxiliary magnets forming a magnetic gap with the main magnet.

However, in the related art, after the elastic conductor is bent and deformed, due to the difference in materials of various layers, residual stress is distributed non-linearly, so that elastic deformation cannot be fully recovered, and the fluctuation range of corresponding bending angles is large, resulting in insufficient precision of pad positions.

Therefore, there is a need to provide a new sounding device to solve the above problems.

SUMMARY OF THE INVENTION

The object of the present invention is to provide a sounding device in which the stress on inner and outer surfaces of bent areas of an elastic conductor is reduced, bending angles are stabilized, springback is reduced, pad positions are precise, and performance is better.

To achieve the above object, the present invention provides a sounding device, comprising a frame, a vibration system fixed to the frame, and a magnetic circuit system configured to drive the vibration system to vibrate to produce sound, wherein the magnetic circuit system has a magnetic gap, and the vibration system comprises a diaphragm fixed to the frame, a voice coil inserted into the magnetic gap to drive the diaphragm to vibrate, a framework connected to the diaphragm, and an elastic conductor fixed to the frame and connected to one side of the framework away from the diaphragm, wherein the framework and the voice coil define a receiving space, and the elastic conductor comprises an elastic conductor body fixed to the frame and connected to one side of the framework away from the diaphragm, a connection arm bending and extending from the elastic conductor body to the receiving space along the framework, and a pad portion connected to the connection arm; the connection arm comprises a first connection portion extending from the elastic conductor body to the voice coil, a first bending portion bending and extending from the first connection portion to the diaphragm, a second connection portion extending from the first bending portion to the diaphragm, a second bending portion bending and extending from the second connection portion to the voice coil, and a third connection portion extending from the second bending portion to the voice coil; the pad portion is connected to the third connection portion; and a covering film is attached to both an inside surface and an outside surface of the connection arm, and the covering film is removed from an inside surface and/or an outside surface of the first bending portion and the second bending portion.

Optionally, the framework comprises a bottom wall fixed to the diaphragm and a sidewall bending and extending in a direction from the bottom wall to the magnetic circuit system, and one side of the sidewall away from the diaphragm is fixedly connected to the elastic conductor body.

Optionally, the bottom wall has a ring shape, and the sidewall comprises a first sidewall bending and extending in a direction from the outer periphery of the bottom wall to the magnetic circuit system and a second sidewall bending and extending in a direction from the inner periphery of the bottom wall to the magnetic circuit system; and the first sidewall is connected to the elastic conductor body, the second sidewall is connected to the voice coil, the first sidewall is spaced from and opposite to the voice coil, and the bottom wall, the first sidewall, and the voice coil define the receiving space.

Optionally, the pad portion comprises a first pad and a second pad that extend away from each other, the connection arm, the first pad, and the second pad are all accommodated in the receiving space, the second connection portion is disposed parallel to and spaced from the first sidewall, and the third connection portion, the first pad, and the second pad are all connected to the side of the bottom wall close to the voice coil.

Optionally, the voice coil has a racetrack shape, has lead wires and comprises a pair of minor-axis sides and a pair of major-axis sides, the at least one first sidewall comprises two first sidewalls that are spaced apart from each other and that are respectively located on the pair of minor-axis sides of the voice coil, and the second sidewall is ring-shaped and connected to one end of the voice coil close to the diaphragm, and the lead wires are fixedly and electrically connected to the first pad and the second pad respectively.

Optionally, the at least one elastic conductor comprises two elastic conductors, which are disposed on two minor-axis sides of the voice coil respectively.

Optionally, the elastic conductor body comprises a first fixed portion fixed to one side of the frame away from the diaphragm, a second fixed portion fixed to one end of the first sidewall away from the diaphragm, and an elastic arm connecting the first fixed portion and the second fixed portion, and the connection arm is fixedly connected to the second fixed portion.

Optionally, the vibration system further comprises an assistant diaphragm attached to one side of the elastic conductor away from the diaphragm.

Optionally, the magnetic circuit system comprises a yoke, a main magnet fixedly disposed on the yoke, an auxiliary magnet disposed around the main magnet and spaced from the main magnet to form the magnetic gap, a first magnetic conductive plate covering and fixed to the main magnet, and a second magnetic conductive plate covering and fixed to the auxiliary magnet, and the second magnetic conductive plate is provided with avoiding portions at corresponding positions of the first pad and the second pad.

Optionally, the diaphragm comprises a vibration portion with a through hole, a suspension portion extending from the periphery of the vibration portion and surrounding the vibration portion, a fixed portion bending and extending from one side of the suspension portion away from the vibration portion and fixed to the frame, and a dome; wherein the vibration portion surrounds and is spaced from the dome, and the bottom wall is located between the dome and the vibration portion and connects the vibration portion and the dome.

Compared with the related art, in the sounding device of the present invention, the elastic conductor comprises an elastic conductor body fixed to the frame and connected to one end of the framework away from the diaphragm, a connection arm bending and extending from the elastic conductor body to the receiving space along the framework, and a pad portion connected to the connection arm; the connection arm comprises a first connection portion extending from the elastic conductor body to the voice coil, a first bending portion bending and extending from the first connection portion to the diaphragm, a second connection portion extending from the first bending portion to the diaphragm, a second bending portion bending and extending from the second connection portion to the voice coil, and a third connection portion extending from the second bending portion to the voice coil; the pad portion is connected to the third connection portion; and a covering film is attached to both an inside surface and an outside surface of the connection arm, and the covering film is removed from an inside surface and/or an outside surface of the first bending portion and the second bending portion. Removal of the covering film reduces the stress on inner and outer surfaces of bent areas of the elastic conductor, so that bending angles are stabilized, springback is reduced, pad positions are precise, and performance of the sounding device is improved.

BRIEF DESCRIPTION OF THE DRAWINGS

To illustrate the technical solutions in the embodiments of the present invention more clearly, a brief introduction to the accompanying drawings required for describing the embodiments will be made below. Obviously, the accompanying drawings in the following description show merely some embodiments of the present invention, and those of ordinary skills in the art may derive other drawings from these accompanying drawings without any creative effort, in which.

DETAILED DESCRIPTION OF EMBODIMENTS

The technical solutions in the embodiments of the present invention will be described clearly and completely below in conjunction with the accompanying drawings for the embodiments of the present invention; and obviously, the embodiments described are merely some, rather than all, of the embodiments of the present invention. All other embodiments obtained by those of ordinary skills in the art based on the embodiments of the present invention without any creative efforts shall all fall within the protection scope of the present invention.

Figure 1:
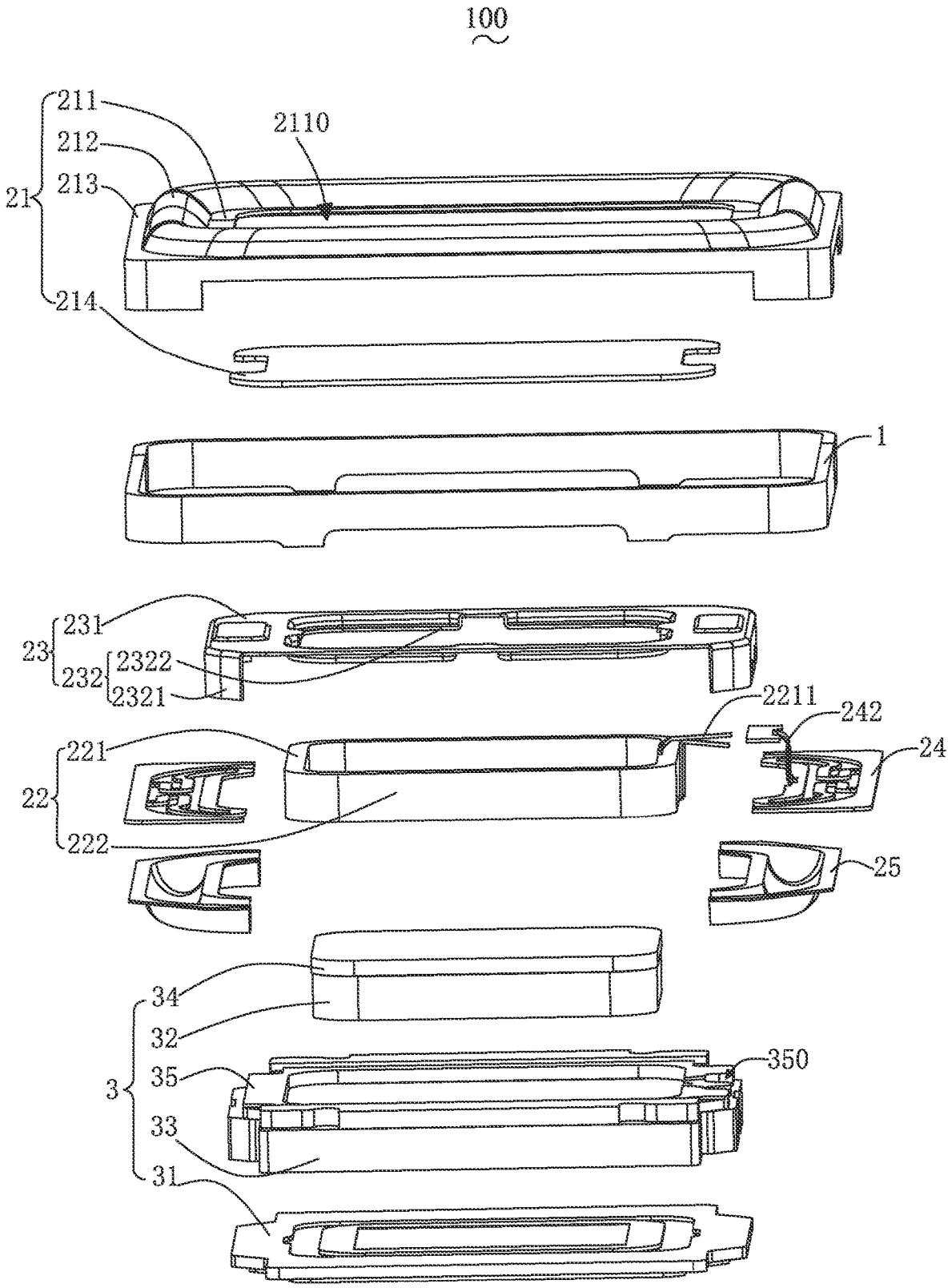
FIG. 1 is a schematic exploded view of a structure of a sounding device according to the present invention.
Figure 2:
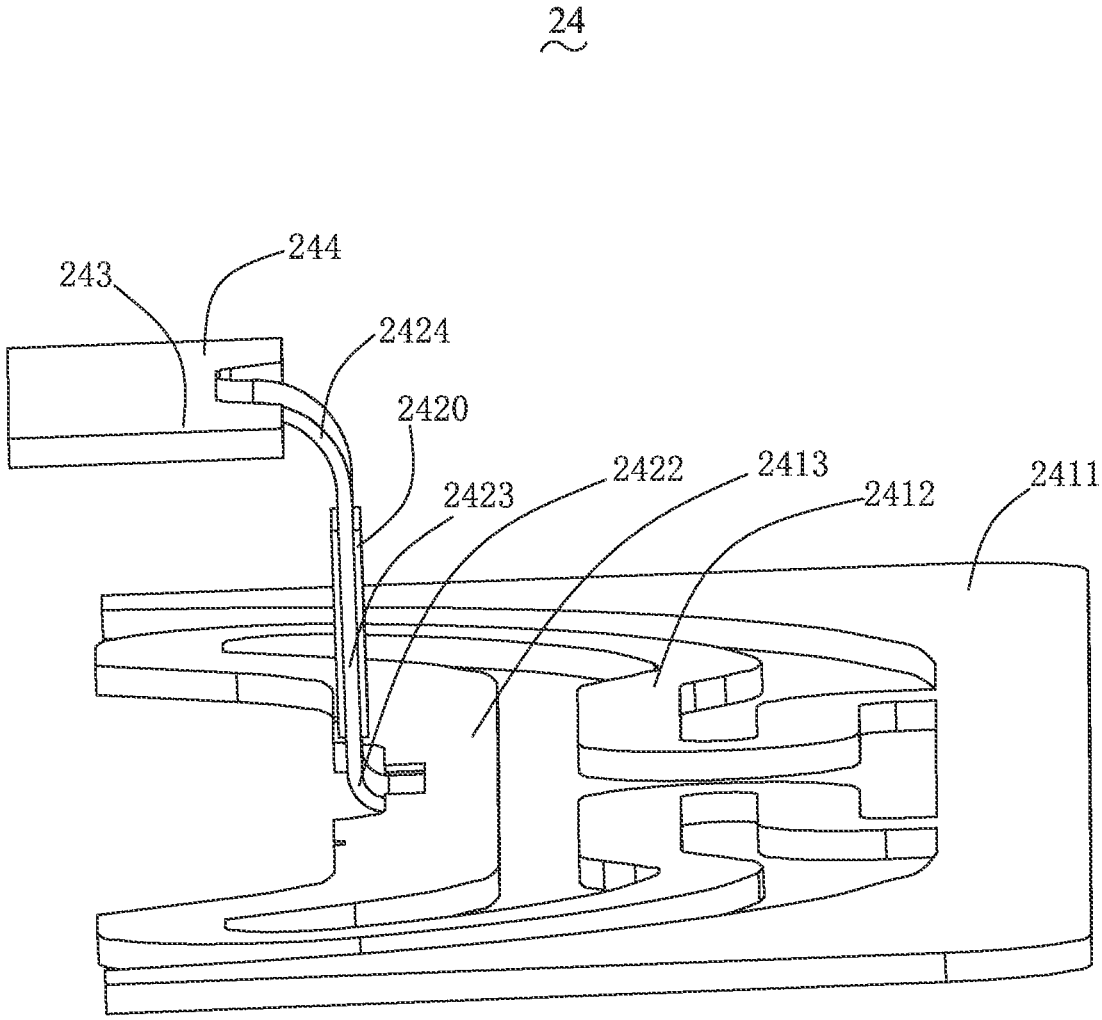
FIG. 2 is a schematic structural view of an elastic conductor of the sounding device according to the present invention.
Figure 3:
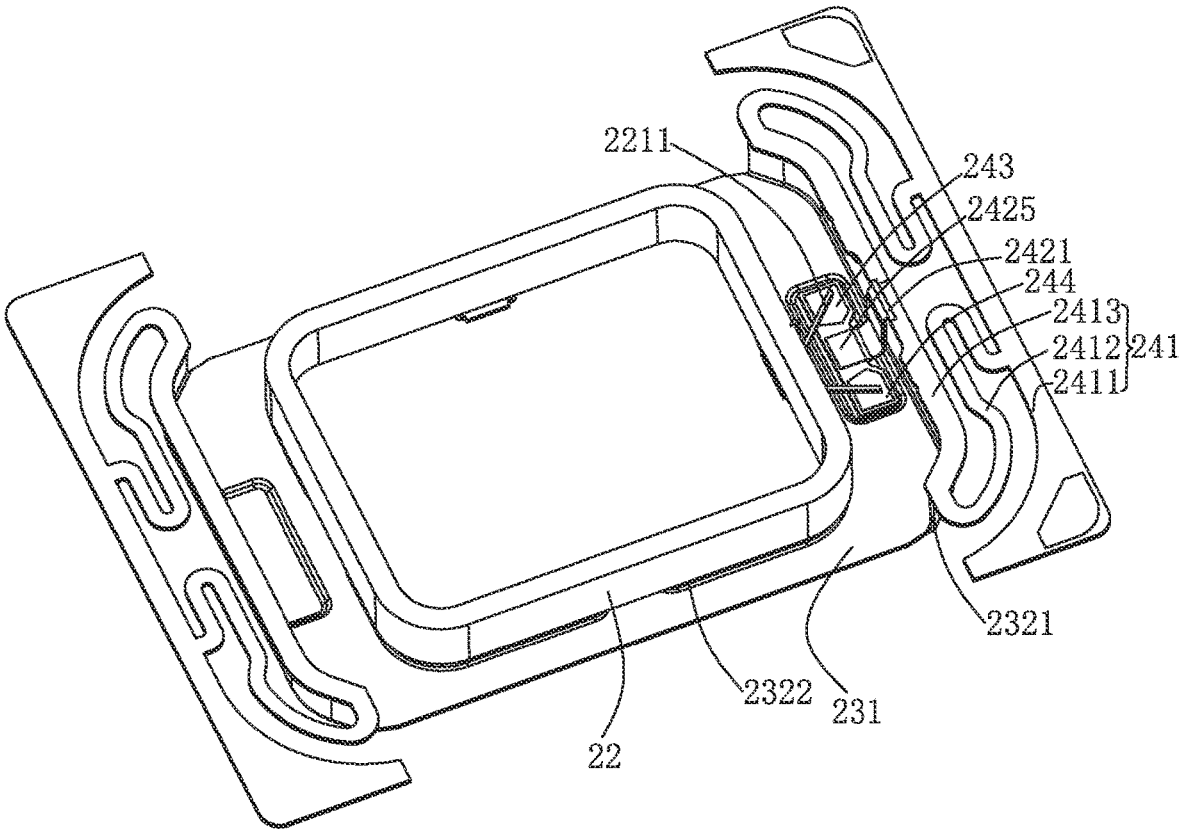
FIG. 3 is a schematic view of partial assembly of the sounding device according to the present invention.
Figure 4:
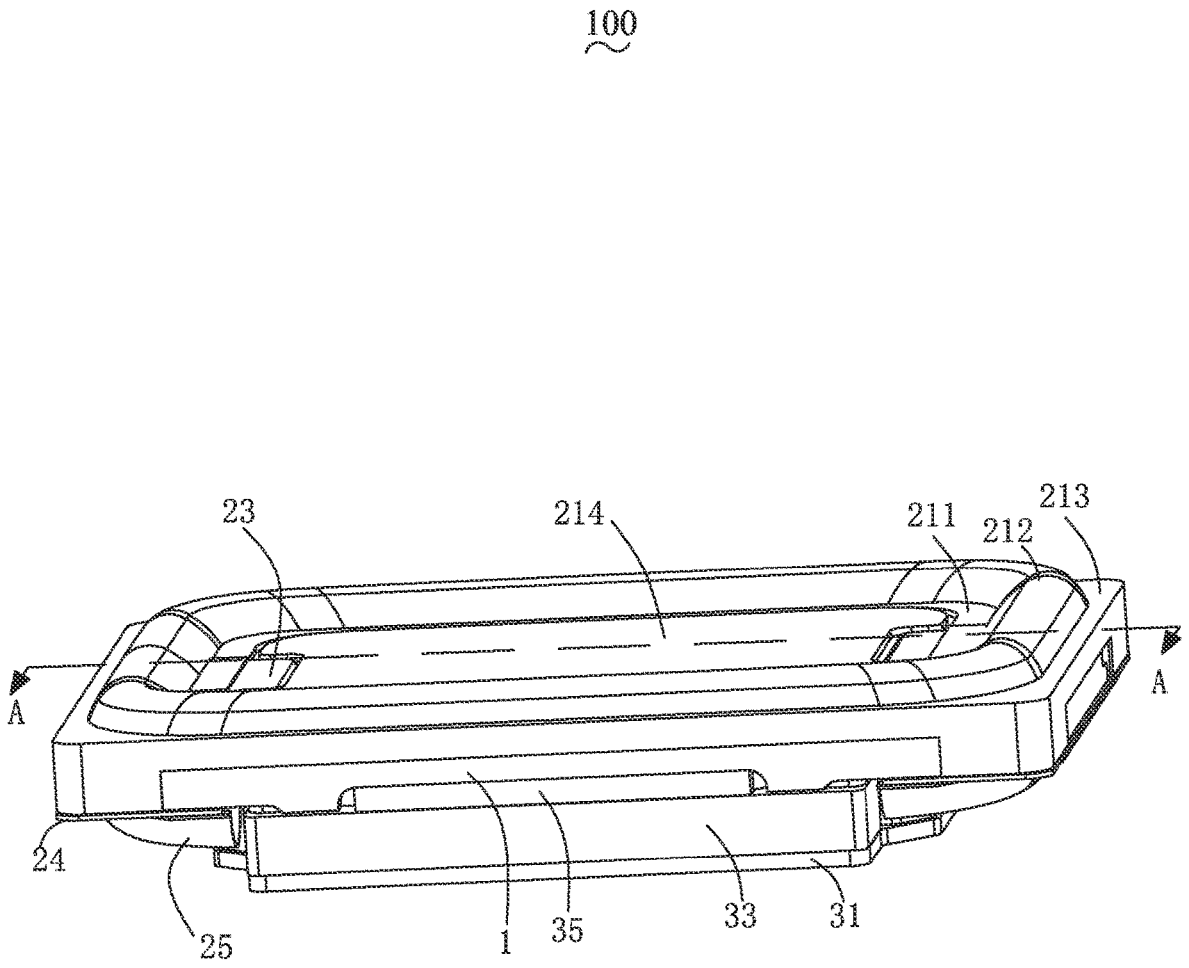
FIG. 4 is a schematic diagram of a three-dimensional structure of the sounding device according to the present invention.
Figure 5:
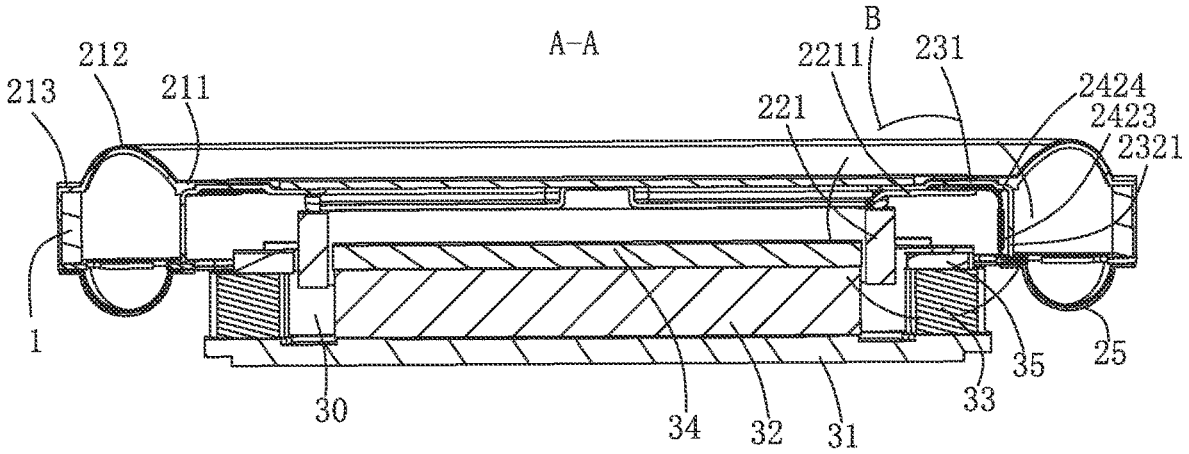
FIG. 5 is a cross-sectional view of the sounding device taken along the line A-A in FIG. 4 according to the present invention.
Figure 6:
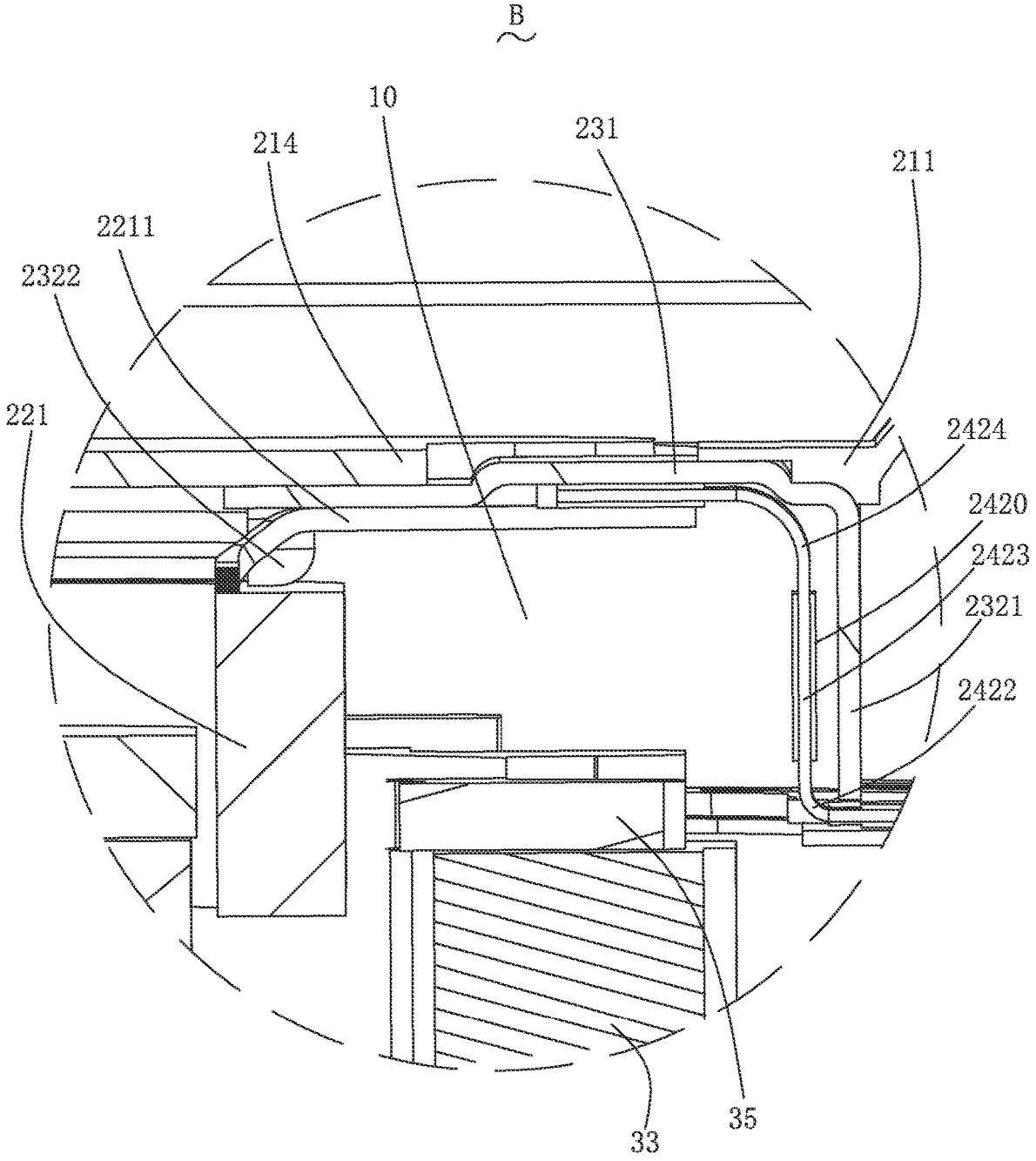
FIG. 6 is a schematic enlarged view of Part B in FIG. 5 according to the present invention.
Figure 7:
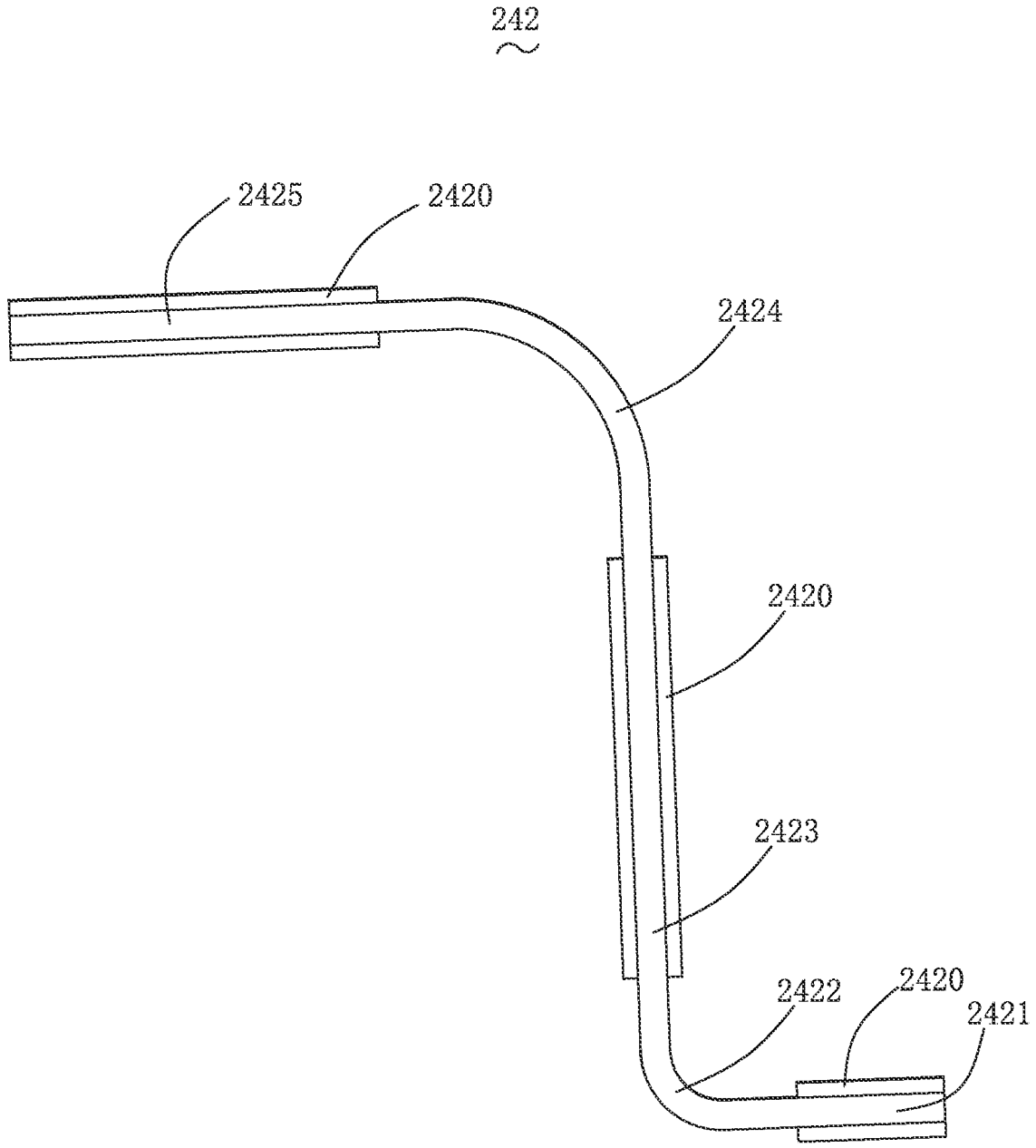
FIG. 7 is a schematic structural view of a connection arm of the elastic conductor according to the present invention.
Figure 8:
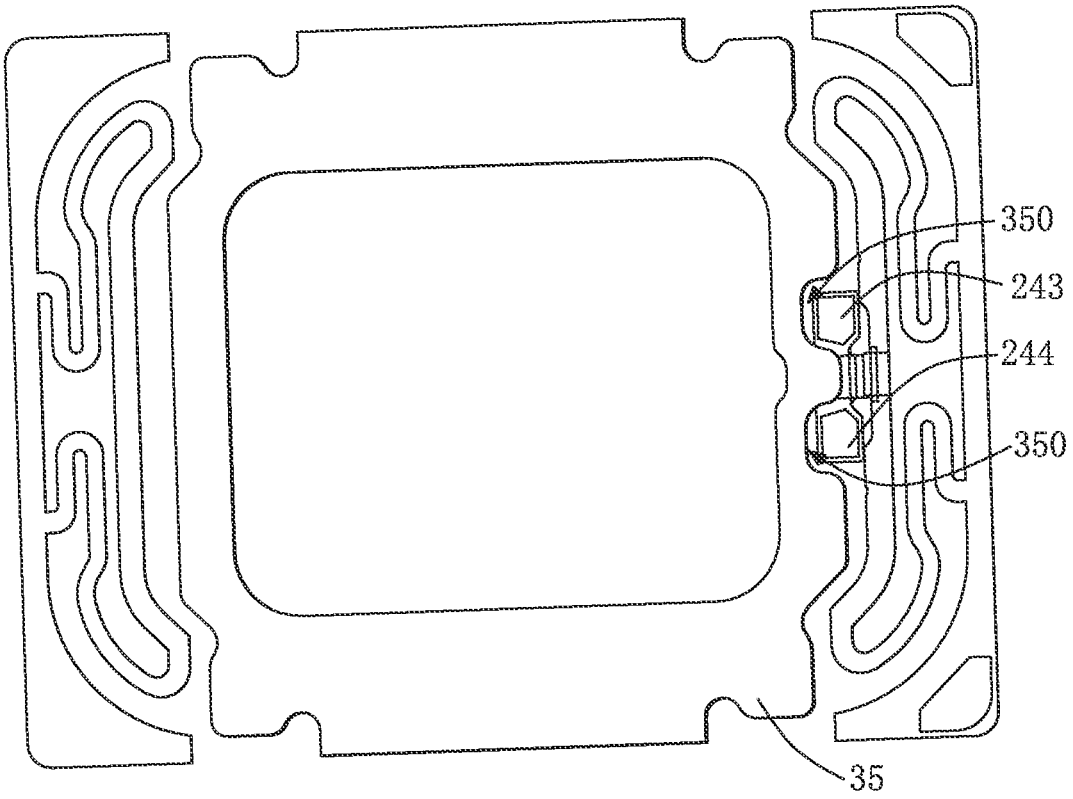
FIG. 8 is a schematic structural view of the elastic conductor and a second magnetic conductive plate according to the present invention.

Referring to FIGS. 1-8, the present invention provides a sounding device 100. The sounding device 100 comprises a frame 1, a vibration system and a magnetic circuit system 3 that are fixed to the frame 1 respectively, wherein the magnetic circuit system 3 drives the vibration system to vibrate and generate sound and has a magnetic gap 30.

Specifically, the vibration system comprises a diaphragm 21 fixed to the frame 1, a voice coil 22 inserted into the magnetic gap 30 for driving the diaphragm 21 to vibrate, a framework 23 connected to the diaphragm 21, an elastic conductor 24 fixed to the frame 1 and connected to the side of the framework 23 away from the diaphragm 21, and an assistant diaphragm 25. The framework 23 and the voice coil 22 define a receiving space 10.

The diaphragm 21 comprises a vibration portion 211 having a through hole 2110, a suspension portion 212 extending from the periphery of the vibration portion 211 and surrounding the vibration portion 211, and a fixed portion 213 bending and extending from the suspension portion 212 to the side away from the vibration portion 211 and fixed to the frame 1, and a dome 214. The vibration portion 211 surrounds and is spaced from the dome 214.

The voice coil 22 has a racetrack shape, with one end away from the diaphragm 21 inserted into the magnetic gap 30, and comprises a pair of minor-axis sides 221 that are spaced from each other and a pair of major-axis sides 222 that are spaced from each other. The minor-axis sides 221 have two lead wires 2211.

The framework 23 comprises a bottom wall 231 that is fixed to the vibration portion 211 and has a ring shape, and a sidewall 232 that bends and extends in a direction from the bottom wall 231 to the magnetic circuit system 3.

Specifically, the sidewall 232 comprises a first sidewall 2321 bending and extending in a direction from the outer periphery of the bottom wall 231 to the magnetic circuit system 3 and a second sidewall 2322 bending and extending in a direction from the inner periphery of the bottom wall 231 to the magnetic circuit system 3. There are two first sidewalls 2321, which are disposed on two opposite sides of short shafts of the voice coil 22 in a spaced manner, the second sidewall 2322 has a ring shape and is connected to the voice coil 22, and the second sidewall 2322 is connected to one end of the voice coil 22 that is close to the diaphragm 21.

The first sidewall 2321 is spaced from and opposite to the voice coil 22, and the bottom wall 231, the first sidewall 2321, and the voice coil 22 define the receiving space 10.

Specifically, the bottom wall 231 is located between the dome 214 and the vibration portion 211 and connects the vibration portion 211 and the dome 214 to form an integral structure, which is more reliable.

There are two elastic conductors 24, which are disposed on two minor-axis sides of the voice coil 22 respectively. The elastic conductor 24 comprises an elastic conductor body 241 fixed to the frame 1 and connected to one end of the framework 23 away from the diaphragm 21, a connection arm 242 bending and extending from the elastic conductor body 241 to the receiving space 10 along the framework 23, and a pad portion connected to the connection arm 242. The pad portion comprises a first pad 243 and a second pad 244 that are formed by extending the connection arm 242 outward away from each other. The lead wires 2211 of the voice coil 22 are fixedly and electrically connected to the sides of the first pad 243 and the second pad 244 away from the diaphragm, respectively.

Specifically, the connection arm 242 comprises a first connection portion 2421 extending from the elastic conductor body 241 to the voice coil 22, a first bending portion 2422 bending and extending from the first connection portion 2421 to the diaphragm 21, a second connection portion 2423 extending from the first bending portion 2422 to the diaphragm 21, a second bending portion 2424 bending and extending from the second connection portion 2423 to the voice coil 22, and a third connection portion 2425 extending from the second bending portion 2424 to the voice coil 22. The first pad 243 and the second pad 244 are disposed on two sides of the third connection portion 2425 respectively. A covering film 2420 is attached to an inside surface and an outside surface of the connection arm 242, and the covering film 2420 is removed from an inside surface and/or an outside surface of the first bending portion 2422 and the second bending portion 2424. Removal of the covering film 2420 reduces the stress on inner and outer surfaces of bent areas of the elastic conductor 24, so that bending angles of the elastic conductor 24 are stabilized, springback is reduced, positions of the first pad 243 and the second pad 244 are precise, and performance of the sounding device is improved.

The second connection portion 2423 is disposed parallel to and spaced from the first sidewall 2321. The third connection portion 2425 extends outward away from each other to form the first pad 243 and the second pad 244, and all three are connected to the side of the bottom wall 231 close to the voice coil 22.

The elastic conductor body 241 comprises a first fixed portion 2411 fixed to the side of the frame 1 away from the diaphragm 21, a second fixed portion 2413 fixed to one end of the first sidewall 2321 away from the diaphragm 21, and an elastic arm 2412 connecting the first fixed portion 2411 and the second fixed portion 2413. The connection arm 242 is fixedly connected to the second fixed portion 2413.

There are two assistant diaphragms 25, which are respectively attached to the side of the elastic conductor 24 away from the diaphragm 21.

The magnetic circuit system 3 comprises a yoke 31, a main magnet 32 fixedly disposed on the yoke 31, an auxiliary magnet 33 disposed around the main magnet 32 and spaced from the main magnet 32 to form the magnetic gap 30, a first magnetic conductive plate 34 covering and fixed to the main magnet 32, and a second magnetic conductive plate 35 covering and fixed to the auxiliary magnet 33. The second magnetic conductive plate 35 is fixedly connected to the side of the frame 1 away from the diaphragm 21 and is provided with avoiding portions 350 at corresponding positions of the first pad 243 and the second pad 244, such that when the sounding device vibrates and generates sound, the second magnetic conductive plate 35 will not collide with the first pad 243 and the second pad 244, without affecting electrical connections between the two and the lead wires 2211, thereby improving the safety of the sounding device.

Compared with the related art, in the sounding device of the present invention, the elastic conductor comprises an elastic conductor body fixed to the frame and connected to one end of the framework away from the diaphragm, a connection arm bending and extending from the elastic conductor body to the receiving space along the framework, and a pad portion connected to the connection arm; the connection arm comprises a first connection portion extending from the elastic conductor body to the voice coil, a first bending portion bending and extending from the first connection portion to the diaphragm, a second connection portion extending from the first bending portion to the diaphragm, a second bending portion bending and extending from the second connection portion to the voice coil, and a third connection portion extending from the second bending portion to the voice coil; the pad portion is connected to the third connection portion; and a covering film is attached to both an inside surface and an outside surface of the connection arm, and the covering film is removed from an inside surface and/or an outside surface of the first bending portion and the second bending portion. Removal of the covering film reduces the stress on inner and outer surfaces of bent areas of the elastic conductor, so that bending angles are stabilized, springback is reduced, pad positions are precise, and performance of the sounding device is improved.

The above descriptions provided in the present invention are merely embodiments of the present invention, and not intended to limit the patent scope of the present invention thereby, and any equivalent structure or equivalent process variations made by using the contents of the description and accompanying drawings are applied directly or indirectly in other relevant technical fields and also included in the scope of patent protection of the present invention.

What is claimed is:

1. A sounding device, comprising:

a frame, a vibration system fixed to the frame, and a magnetic circuit system configured to drive the vibration system to vibrate to produce sound, wherein the magnetic circuit system has a magnetic gap, and the vibration system comprises a diaphragm fixed to the frame, a voice coil inserted into the magnetic gap to drive the diaphragm to vibrate, a framework connected to the diaphragm, and an elastic conductor fixed to the frame and connected to one side of the framework away from the diaphragm, wherein the framework and the voice coil define a receiving space, and the elastic conductor comprises an elastic conductor body fixed to the frame and connected to one side of the framework away from the diaphragm, a connection arm bending and extending from the elastic conductor body to the receiving space along the framework, and a pad portion connected to the connection arm; the connection arm comprises a first connection portion extending from the elastic conductor body to the voice coil, a first bending portion bending and extending from the first connection portion to the diaphragm, a second connection portion extending from the first bending portion to the diaphragm, a second bending portion bending and extending from the second connection portion to the voice coil, and a third connection portion extending from the second bending portion to the voice coil; the pad portion is connected to the third connection portion; and a covering film is attached to both an inside surface and an outside surface of the connection arm, and the covering film is removed from an inside surface and/or an outside surface of the first bending portion and the second bending portion.

2. The sounding device as described in claim 1, wherein the framework comprises a bottom wall fixed to the diaphragm and a sidewall bending and extending in a direction from the bottom wall to the magnetic circuit system, and one side of the sidewall away from the diaphragm is fixedly connected to the elastic conductor body.

3. The sounding device as described in claim 2, wherein the bottom wall has a ring shape, and the sidewall comprises a first sidewall bending and extending in a direction from the outer periphery of the bottom wall to the magnetic circuit system and a second sidewall bending and extending in a direction from the inner periphery of the bottom wall to the magnetic circuit system; and the first sidewall is connected to the elastic conductor body, the second sidewall is connected to the voice coil, the first sidewall is spaced from and opposite to the voice coil, and the bottom wall, the first sidewall, and the voice coil define the receiving space.

4. The sounding device as described in claim 3, wherein the pad portion comprises a first pad and a second pad that extend away from each other, the connection arm, the first pad, and the second pad are all accommodated in the receiving space, the second connection portion is disposed parallel to and spaced from the first sidewall, and the third connection portion, the first pad, and the second pad are all connected to the side of the bottom wall close to the voice coil.

5. The sounding device as described in claim 4, wherein the voice coil has a racetrack shape, has lead wires and comprises a pair of minor-axis sides and a pair of major-axis sides, the at least one first sidewall comprises two first sidewalls that are spaced apart from each other and that are respectively located on the pair of minor-axis sides of the voice coil, and the second sidewall is ring-shaped and connected to one end of the voice coil close to the diaphragm, and the lead wires are fixedly and electrically connected to the first pad and the second pad respectively.

6. The sounding device as described in claim 3, wherein the at least one elastic conductor comprises two elastic conductors, which are disposed on two minor-axis sides of the voice coil respectively.

7. The sounding device as described in claim 6, wherein the elastic conductor body comprises a first fixed portion fixed to one side of the frame away from the diaphragm, a second fixed portion fixed to one end of the first sidewall away from the diaphragm, and an elastic arm connecting the first fixed portion and the second fixed portion, and the connection arm is fixedly connected to the second fixed portion.

8. The sounding device as described in claim 7, wherein the vibration system further comprises an assistant diaphragm attached to one side of the elastic conductor away from the diaphragm.

9. The sounding device as described in claim 2, wherein the diaphragm comprises a vibration portion with a through hole, a suspension portion extending from the periphery of the vibration portion and surrounding the vibration portion, a fixed portion bending and extending from one side of the suspension portion away from the vibration portion and fixed to the frame, and a dome; wherein the vibration portion surrounds and is spaced from the dome, and the bottom wall is located between the dome and the vibration portion and connects the vibration portion and the dome.

10. The sounding device as described in claim 1, wherein the magnetic circuit system comprises a yoke, a main magnet fixedly disposed on the yoke, an auxiliary magnet disposed around the main magnet and spaced from the main magnet to form the magnetic gap, a first magnetic conductive plate covering and fixed to the main magnet, and a second magnetic conductive plate covering and fixed to the auxiliary magnet, and the second magnetic conductive plate is provided with avoiding portions at corresponding positions of the first pad and the second pad.

* * * * *